US005438394A

United States Patent [19]

Suzuki et al.

[11] Patent Number: 5,438,394

[45] Date of Patent: Aug. 1, 1995

[54] IMAGE FORMING APPARATUS USABLE WITH A CARRIER HAVING MAGNETIZATION CONTROLLED IN RELATION TO RECORDING DENSITY

[75] Inventors: Hiroyuki Suzuki, Machida; Yukio Nagase, Tokyo; Kenichiro Waki, Kawasaki; Kazuhisa Kemmochi, Hachiohji; Masaru Hibino, Kawasaki, all of Japan

[73] Assignee: Canon Kabushiki Kaisha, Tokyo, Japan

[21] Appl. No.: 83,899

[22] Filed: Jun. 29, 1993

[30] Foreign Application Priority Data

Jun. 30, 1992 [JP] Japan ..... 4-173253

[51] Int. Cl.[6] ..... G03G 15/09

[52] U.S. Cl. ..... 355/251; 118/657; 355/239; 347/140

[58] Field of Search ..... 355/251, 268, 252, 253, 355/259, 208, 246, 239; 118/623, 652, 657, 658, 653; 346/153.1; 358/298, 300

[56] References Cited

U.S. PATENT DOCUMENTS

| | | | |
|---|---|---|---|
| 4,336,546 | 6/1982 | Edwards et al. | 118/652 |
| 4,387,664 | 6/1983 | Hosono et al. | 118/658 |
| 4,391,512 | 7/1983 | Nakamura et al. | 118/657 X |
| 4,627,703 | 12/1986 | Suzuki et al. | 355/271 |
| 4,743,937 | 5/1988 | Martin | 355/259 |
| 4,755,847 | 7/1988 | Matsushiro et al. | 355/259 |
| 4,876,574 | 10/1989 | Tajima et al. | 355/253 |
| 5,038,158 | 8/1991 | Ayers et al. | 346/153.1 |
| 5,051,782 | 9/1991 | Yamaji | 355/251 |
| 5,110,705 | 5/1992 | Hosoya et al. | 118/653 X |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

An image forming apparatus includes an image bearing member; a latent image forming device for forming on the image bearing member a dot distribution electrostatic latent image in accordance with image signals corresponding to an object image; a developing device for developing the latent image formed on the image bearing member by the latent image forming device, in a developing station and by a developer containing toner and magnetic carrier; wherein the developing device includes a developer carrying member for carrying and conveying the developer to the developing station, and a magnetic field generating device provided within the developer carrying member, for forming a magnetic brush of the developer and contacting the magnetic brush to the image bearing member; and wherein a degree $\sigma d$ (emu/cm$^3$) of magnetization of the magnetic carrier by a magnetic field by the magnetic field generating means at a peak of a perpendicular magnetic field on the surface of the developer carrying member satisfies the following:

if $X<200$, then $30 \leqq \sigma d \leqq 15000/X$ if $X \geqq 200$, then $30 \leqq \sigma d \leqq 75$ wherein X is the number of picture elements per square millimeter in the electrostatic latent image, and is no less than 60 and no more than 1000.

13 Claims, 10 Drawing Sheets

IMAGE FORMING APPARATUS USABLE WITH A CARRIER HAVING MAGNETIZATION CONTROLLED IN RELATION TO RECORDING DENSITY

FIELD OF THE INVENTION AND RELATED ART

The present invention relates to an image forming apparatus comprising a developing apparatus for developing, by a magnetic brush formed of a developer composed of a toner and a magnetic carrier, a dot distribution electrostatic latent image on an image bearing member in response to image signals from a target or object image.

There are known image forming methods in which an electrophotographic sensitive member is exposed to a laser beam modulated in response to signals from a target image, to form an electrostatic latent dot distribution image, that is, a latent image formed by dots distributed in correspondence with the tone of the target image.

Among these methods, the so-called pulse width modulation (PWM) method, in which the pulse width (in other words, duration) of the laser driving pulse current is modulated according to the tone of the target image, can provide a high recording density (in other words, high resolution), as well as high gradation.

However, when an electrostatic latent dot distribution image is formed by the PWM method on a photosensitive member, and this electrostatic image is reverse developed by a magnetic brush formed of a two-component developer, being placed in contact with the photosensitive member, the developed image displays roughness (dispersion of minute density irregularities) in its half tone area having a reflection density of less than 0.3. This roughness is rarely displayed in the case of a text original or the like, but is frequently displayed in the low density area of a photographic original or the like. Therefore, studies have been made on the causes of this roughness, and the following have been revealed.

When a low density portion of the latent image is formed as a distribution of latent dot images, the latent image on the photosensitive member shows a two dimensional local distribution of the latent dot image as shown in FIG. 2, instead of a latent image having a broad distribution like an analog latent image. Further, when an attempt is made to reproduce even lower density, the contrast of the latent dot distribution image is diluted by the influence from the film thickness of the photosensitive member, and the maximum contrast $V_0$(difference in potential between a non-exposed portion and a portion having the smallest absolute potential value in the latent dot distribution image) gradually diminishes as shown in FIG. 2.

For example, when an attempt is made to reproduce an image having a reflection density of approximately 0.2, the $V_0$ of this latent dot distribution image becomes approximately 150–200 V.

On the other hand, in case of the reverse development, in which toner is adhered to the exposed portion of the photosensitive member, the DC voltage component of the oscillating development bias voltage is set 100–200 V lower, in terms of absolute value, than the surface potential of the non-exposed (non-image portion), in order to prevent fogging, and therefore, the potential difference $V_{cont}$ between the exposed portion of the latent dot distribution image and the DC voltage component of the development bias becomes approximately 0–50 V if $V_0$ is 150–200 V. This $V_{cont}$ of 0–50 V translates into an extremely instable contrast, in other words, a borderline contrast at which the toner may either adhere to the photosensitive member side or remain on the developer bearing member side. Therefore, when the above mentioned latent dot distribution image is developed by the two-component developer, the manner in which the magnetic brush contacts the photosensitive member greatly contributes to the development efficiency. In other words, roughness is likely to be caused by missing dots or the like which corresponds to the imperfection of the fibers (chain like arrangements) of the magnetic brush.

FIG. 3 depicts the roughness. In FIG. 3, P refers to a single picture element. In the respective picture elements P, L1–L5 are latent dot distribution images formed by a laser beam modulated by the PWM method, and correspond to the low density areas of the target image. D1–D4 designate the toner adhering portions of the latent dot distribution images L1–L4, that is, the developed portions. The latent dot distribution image L2 has been completely developed. However, the latent dot distribution images L1, L3, and L4 have been only partially developed. The latent dot distribution image L5 has not been developed at all.

The low density area appears rough since the imperfectly developed latent dot distribution images are two-dimensionaly distributed, and when a color image is formed by superposing two or more color toners, this roughness is particularly obtrusive, deteriorating thereby the picture quality.

SUMMARY OF THE INVENTION

The object of the present invention is to develop an electrostatic latent dot distribution image which corresponds to a low density portion, into a visible image with less visible roughness, so that a high quality image can be formed.

Another object of the present invention is to provide an image forming apparatus capable of controlling the relation between the recording density and the degree of the magnetization of the magnetic carrier.

Further objects of the present invention will become more apparent upon consideration of the following description of the preferred embodiment of the present invention.

DETAILED DESCRIPTION OF THE PREFERRED EMBODIMENT

Figure 4:
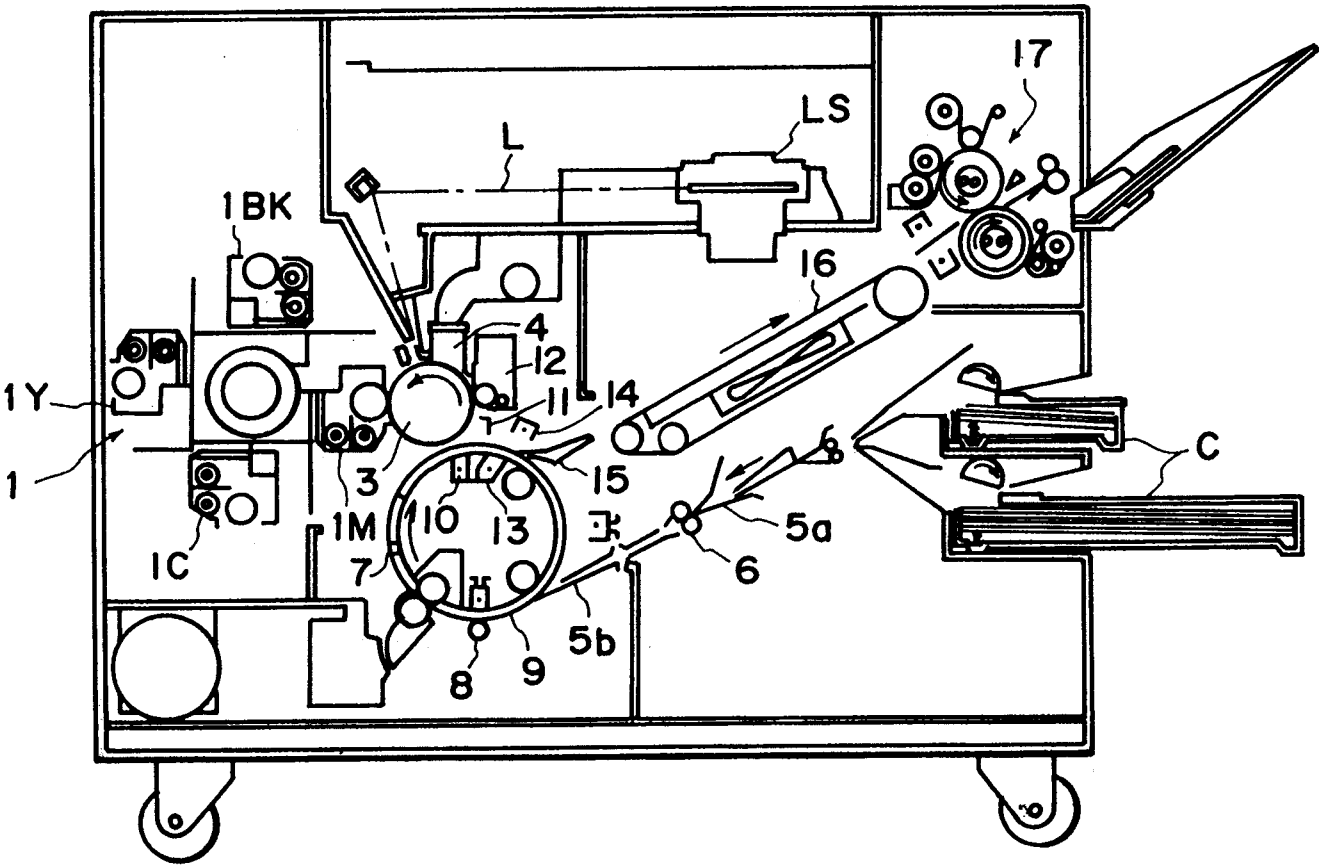
FIG. 4 is schematic side view of an example of color electrophotographic apparatus usable with the present invention.

FIG. 4 shows an electrophotographic color printer usable with the present invention. This printer comprises an electrophotographic photosensitive drum 3 as an image bearing member which rotates in the direction indicated by an arrow. This photosensitive drum 3 is surrounded by a charger 4, a revolving developing apparatus 1 comprising developers 1M, 1C, 1Y, and 1BK, a transfer charger 10, cleaning means 12, and a laser beam scanner LS disposed above the photosensitive drum 3 in this figure, forming together an image forming means. Each of the developers supplies the drum 3 with two-component developer containing toner and carrier particles. The developers in the developers, 1M, 1C, 1Y, and 1BK contain magenta toner, cyan toner, yellow toner, and black toner, respectively.

The original to be copied is read by an unshown text reader. This text reader has a photoelectric transducer such as a CCD for converting the text image into electric signals, which are outputted as image signals, corresponding to the image data for the magenta image, cyan image, yellow image, and black and white image, respectively, of the original. The built-in semiconductor laser of the scanner LS is controlled in response to these image signals to emit a laser beam L. Incidentally, output signals from a computer or the like also can be printed out by this color printer. To describe concisely a general sequence of the color printer operation referring to a full color mode, first, photosensitive drum 3 is uniformly charged by charger 4. Next, the drum is exposed to the scan by the laser beam L modulated in response to the magenta image signal, whereby an electrostatic latent dot distribution image is formed on the photosensitive drum 3. This latent image is reverse developed by the magenta developer 1M fixed at a predetermined developing location.

Meantime, a transfer material such as a sheet of paper, which has been fed out of a cassette C, and advanced along a feed guide 5*a*, a feed roller 6, feed guide 5*b*, is held by a gripper 7 of a transfer drum 9, and is electrostatically wrapped around the transfer drum 9 by the contact roller 8 and its complimentary electrode disposed across the transfer material. The transfer drum 9 is rotated in the direction indicated by an arrow, in synchronization with the photosensitive drum 3. The visual magenta image developed by the magenta developer 1M is transferred onto the transfer material by the transfer charger 10 in the transfer station. The transfer drum 9 is kept rotating to prepare for transfer of the image made of the next color (cyan in FIG. 4).

The photosensitive drum 3 is cleared of the charge by the charger 11, cleaned by the cleaning means 12, recharged by the charger 4, and exposed to the laser beam L modulated this time in response to the cyan image signal as described regarding the magenta image, whereby another electrostatic latent image is formed. Meanwhile, the developing apparatus 1 is rotated to place the cyan developer 1C at the predetermined developing position, where the latent electrostatic dot distribution image corresponding to the cyan image is reverse developed into a visual cyan image.

Next, the same process as described above is sequentially carried out using the yellow and black-and-white image signals. After completion of the visual image (toner image) transfer operations for four colors, the transfer material is cleared of charge by the chargers 13 and 14, released from the gripper 7, separated from the transfer drum 9 by a separating claw 15, and sent to a fixing apparatus 17 (heat roller type fixing apparatus) by a conveyer belt 16. The fixing apparatus 17 fixes the visual image composed of four color images superposed on the transfer material, which concludes one cycle of the full color printing sequence, forming a desired full color printed image.

Figure 5:
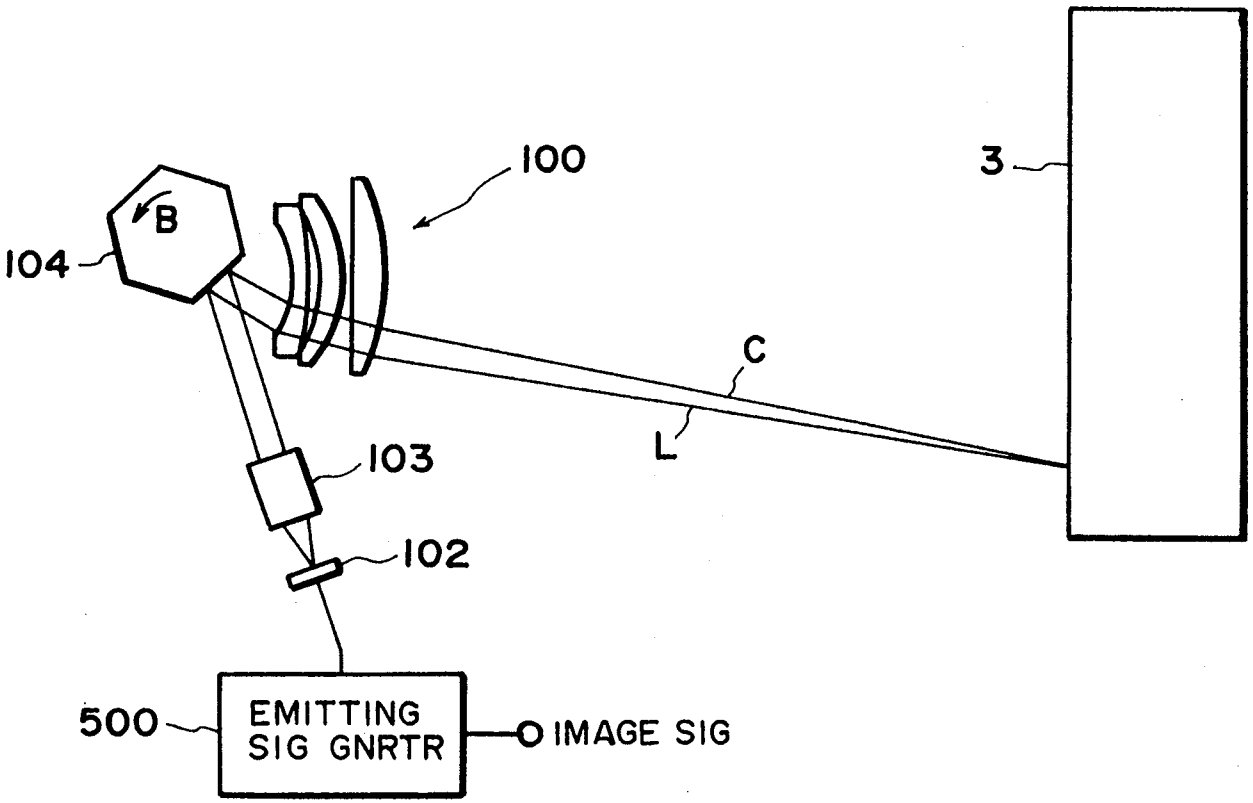
FIG. 5 is a schematic view of a laser beam scanner usable with the present invention.

In FIG. 5, the semiconductor laser element 102 is connected to a laser driver 500 which is a signal generator for sending out a light emission signal (driver signal) for generating the laser beam, and is turned on or off in response to the light emission signal from this laser driver. The laser beam L emitted from the laser element 102 is collimated by a collimator lens system 103 into substantially parallel rays.

Polygon mirror 104, that is, a rotatable multifaceted mirror, is rotated at a predetermined speed in the arrow B direction, scanning thereby the parallel rays emitted from the collimator lens system 103 in the arrow C direction. An f-$\theta$ lens group 100 disposed in front of the polygon mirror 104 spot focuses the laser beam polarized by the polygon mirror 104 on the surface to be scanned, in other words, on the photosensitive drum 3, while keeping constant the scanning speed on the surface to be scanned. The photosensitive member 3 is exposed to the scan by the laser beam L in the above described manner, whereby an electrostatic latent dot distribution image is formed on the photosensitive member 3.

Each of the above described developers carries out reverse development. In other words, toner charged by the charger 4 to the same polarity as the charger polarity is adhered to the drum surface area holding a polarity corresponding to the light portions of the latent image, and therefore, the laser beam L exposes the portions of the drum 3 surface where the toner is to be adhered.

Here, in the present invention, a single picture element means a minimum unit of gradation data, which equals the minimum recording unit in a multi-value recording such as the PWM system. In other words, a picture element exposed by the beam driven by a pulse having a duration equal to the minimum recording unit becomes a picture element having the maximum density; a picture element comprising a portion exposed by the beam driven by a pulse having a duration shorter than the above duration and a non-exposed portion becomes a picture element having an intermediate density; and a picture element comprising only the non-exposed portion becomes a picture element having the minimum density (white background).

On the other hand, in the case of a dither system or the like, which outputs a quantized continuous tone with the use of binary recording, that is, in case the quantized continuous tone is outputted with use of a minimum recording unit of, for example, 2×2, a set of four minimum recording units forms one picture element.

In this embodiment, a multivalue recording, in which the minimum recording unit is one picture element, is made with use of the PWM method. Therefore, the PWM system will be briefly described below.

Figure 6:
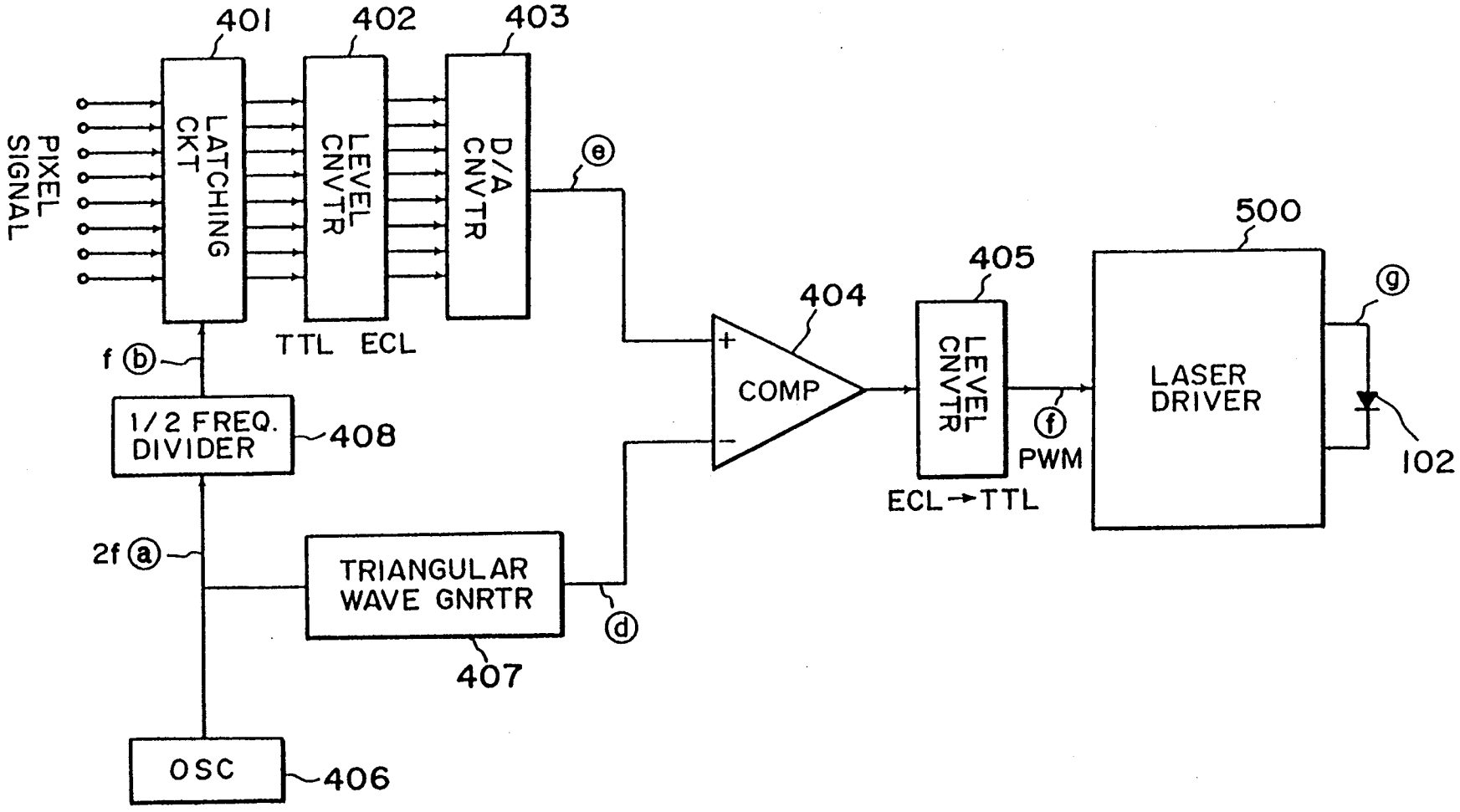
FIG. 6 is a block diagram of a PWM circuit.
Figure 7:
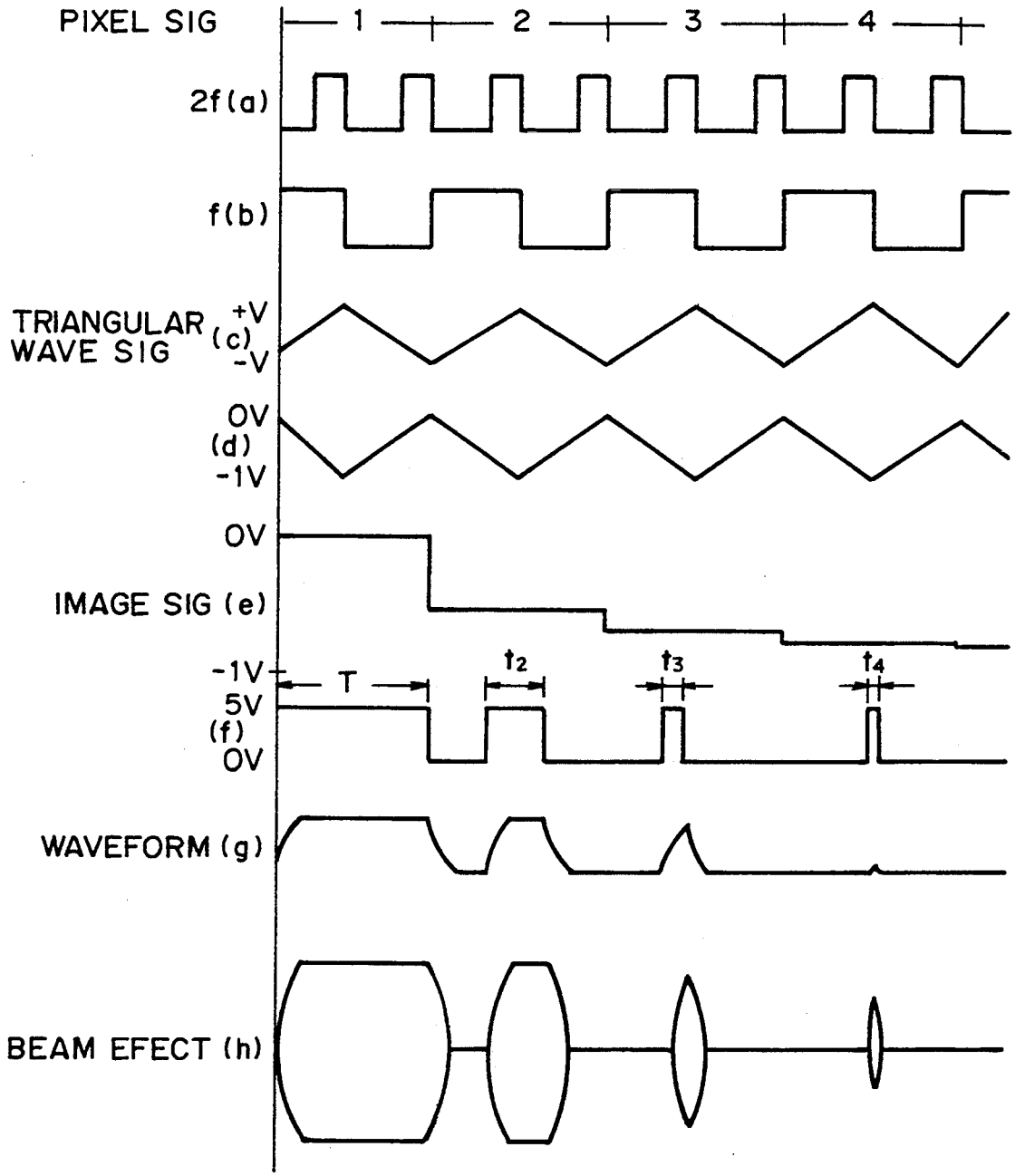
FIG. 7 shows signal waveforms of the PWM method.

FIG. 6 is a block diagram showing an example of the pulse width modulation circuit. FIG. 7 is a timing chart showing an operation of the pulse width modulation circuit.

In FIG. 6, 401 is a TTL latch circuit; 402 is a level converter for converting a TTL logic level to a high speed ECL logic level; 403 is a D/A converter for converting the ECL logic level to an analog signal; 404 is an ECL comparator for generating a PWM signal; 405 is a level converter for converting the ECL logic level to the TTL logic level; 406 is a clock generator for generating a clock signal 2f; 407 is a triangular wave generator for generating a substantially perfect triangular wave signal in synchronization with the clock signal 2f; and 408 is a frequency divider for creating a clock signal f by means of dividing the clock signal 2f in half, whereby the clock signal 2f has twice the frequency of the imaging clock signal f. Further, in order to allow the circuits to operate at high speed, ECL logic circuits are disposed wherever needed.

Referring to the timing chart in FIG. 7, the operations of the circuits comprising such structures as the above will be described hereinafter. Signals a and b designate the clock signal 2f and imaging signal f, respectively, and they are shown with reference to the image signals as shown in FIG. 7. Also, in the triangular wave generator 407, the clock signal 2f is first divided in half before generating the triangular wave signal c, in order to keep a duty ratio of 50%. Further, this triangular wave signal c is converted to the ECL level (0--1 V), becoming thus a triangular wave signal d.

On the other hand, the image signal has, for example, 256 tone levels from 00h (white) to FFh (black). Here, a code "h" indicates the hexadecimal number system. An image signal e reflects the ECL level obtained by the D/A conversion of several image signal values. For example, the first picture element compares to a voltage corresponding to the maximum density level of FF; the second picture image an intermediate level of 80h; the third picture element another intermediate level of 40h; and the fourth picture element compares to a voltage corresponding to another intermediate level of 20h.

The comparator 404 compares the triangular wave signal d to the image signal e, whereby it generates PWM signals T, t2, t3, or t4, having pulse widths corresponding to the densities of the image to be formed. The lower the density of the picture element, the narrower the pulse width becomes. Thus, the PWM signal is converted to a TTL level of 0 V or 5 V, becoming a PWM signal f, to be inputted to the laser driver circuit 500. By means of varying the exposure time per single picture element in response to the PWM signal value obtained in the above described manner, it is possible to produce 256 tones per single picture element.

In FIG. 7, g designates the waveform of current supplied to the laser element 102, and h designates the size and form of the area of the photosensitive member, exposed to the laser beam emitted in response to each of the pulse widths. The size and form of each of the latent dot images substantially compares to this size and form of the exposed areas.

Figure 8:
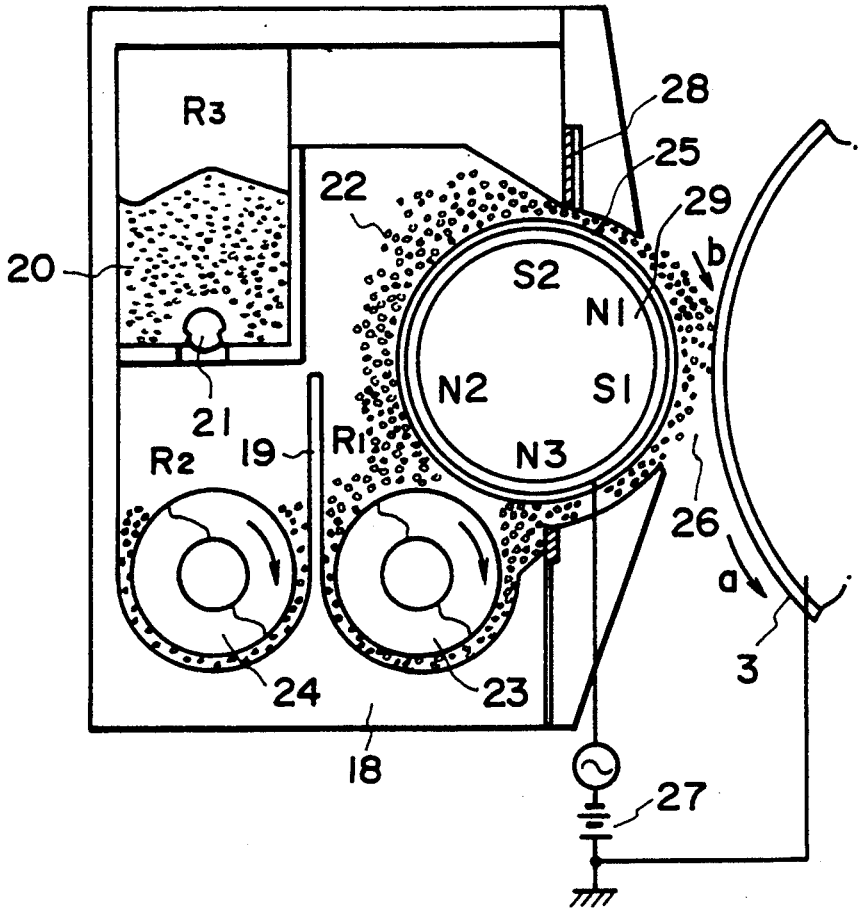
FIG. 8 is a schematic side view of a developing apparatus usable with the present invention.

As for the signal waveforms designated by a to g, the abscissa represents time, and as for h, the abscissa represents the distance in the beam scanning direction. Each of the developers 1M to 1BK for developing the latent electrostatic dot image formed on the photosensitive drum 3 comprises a developer container 18, as shown in FIG. 8.

The internal space of the developer container 18 is divided into a developing chamber (first chamber) R1 and a stirring chamber (second chamber) R2, by a partition wall 19. Upward of the stirring chamber R2, there is a toner storage chamber R3, in which a toner supply (non-magnetic toner) 20 is stored. The toner storage chamber R3 has a feed opening 21, through which the toner supply 20 is dropped into the stirring chamber R2, by an amount equal to the amount consumed by the developing operation.

On the other hand, the developing chamber R1 and stirring chamber R2 contain a developer 22 obtained by mixing the above described toner and magnetic carrier particles.

As for the toner, a known toner obtained by adding coloring agents, charge control agents, or the like to a binder resin may be employed, wherein one having a volume average particle diameter of 5–15 μm is preferable. Here, the volume average particle diameter is measured using a method described hereinafter.

As a measuring instrument, a Coalter counter TA-II (Coalter Corporation) is used, to which an interface for outputting the count average distribution and volume average distribution, and a CX-i personal computer (Canon) are connected. As for the electrolyte, a 1% water solution of NaCl is prepared using sodium chloride of the first grade.

As to the measuring method, a surfactant (preferably, alkyl benzene sodium sulfonate) is added as a dispersant by 0.1–5.0 ml, to 100–150 ml of the above mentioned electrolyte, as well as 0.5–50 mg of test material.

The electrolyte in which the test material is suspended is treated by an ultrasonic dispersing apparatus, and then, the particle size distribution of particles having diameters of 2–40 μm is measured using the Coalter counter TA-II fitted with an aperture of 100 μm, to obtain the volume distribution.

The volume average particle diameter of the sample is derived from the thus obtained volume distribution.

As the magnetic carrier, magnetic particles, on the surface of which an extremely thin resin coating is given, or the like, is preferably employed, wherein the average particle diameter is preferred to be 5–70 μm.

The average particle diameter of the carrier is indicated by the maximum chord length in the horizontal direction. As for its measuring method, the microscopic method is used, in which no less than 300 carrier particles are selected at random and their diameters are actually measured. Then, these actually measured diameters are arithmetically averaged to obtain the carrier particle diameter of the present invention.

A conveyer screw 23 is disposed in the developing chamber R1. As the conveyer screw rotates, the developer 22 in the developing chamber R1 is conveyed in the longitudinal direction of a developing sleeve 25.

There is a conveyer screw 24 in the stirring chamber R2, and as the conveyer screw 24 rotates, the toner is conveyed in the longitudinal direction of the developing sleeve 25. The direction in which the developer is conveyed by the conveyer screw 24 is opposite to that of the conveyer screw 23.

There are openings in the partition wall 19, in front and at the rear, through one of which the developer conveyed by the conveyer screw 23 is transferred to the conveyer screw 24, and through the other of which the developer conveyed by the conveyer screw 24 is transferred to the conveyer screw 23.

Meanwhile, the toner is charged through the friction between the toner particles and the magnetic particles, to a polarity suitable for developing the latent image.

The developer container 18 has an opening adjacent to the photosensitive drum 3, and through this opening, the developing sleeve 25, that is, the developer carrying member, composed of non-magnetic material such as aluminum or non-magnetic stainless steel, is exposed.

The developing sleeve 25 rotates in the arrow b direction to carry the developer of the toner-carrier mixture to a developing station 26. The magnetic brush formed of the developer carried by the developing sleeve 25 comes in contact with the photosensitive drum 3 rotating in the arrow a direction in the developing station 26, whereby the electrostatic latent image is developed in the developing station 26.

The developing sleeve 25 is imparted by a power source 27 with an oscillating bias voltage, that is, an AC voltage biased by a DC voltage. The latent image potential corresponding to the dark portion (potential of a non-exposed portion) and the latent image potential corresponding to the light portion (potential of an exposed portion) fall between the maximum and minimum values of the above mentioned oscillating bias potential. Thus, an alternating electric field in which the magnitude oscillates is generated in the developing station 26. The toner and carrier subjected to this alternating field are vigorously vibrated, whereby the toner breaks off the electrostatic attraction by the sleeve and carrier, to be adhered to the photosensitive drum 3, corresponding to the latent image.

The difference (peak-to-peak voltage) between the maximum and minimum values of the oscillating bias voltage is preferred to be 1–5 kV, and the frequency is preferably 1–10 kHz. As for the waveform of the oscillating bias voltage, a rectangular wave, sine wave, triangular wave, or the like can be employed.

The DC voltage component has a voltage value between the potentials of the dark portion and the light portion of the latent image. However, in order to prevent the fog-inducing toner from being attracted to the dark portion potential areas, the absolute value of the DC voltage component is preferred to be closer to the value of the dark portion potential than the minimum light portion potential.

The minimum clearance between the developing sleeve 25 and photosensitive drum 3 (the location of this minimum clearance falls within the developing station 26) is preferably 0.2–1 mm.

Reference numeral 28 designates a regulator blade for regulating the thickness of the layer of two-component developer carried to the developing station 26 by the developing sleeve 25. The amount of the developer conveyed to the developing station 26 while being regulated by the regulator blade 28 is preferably determined so that the height, under the condition in which the photosensitive drum 3 is off, of the magnetic brush formed of the developer by the magnetic field induced in the developing station by a development magnetic pole $S_1$ (described later) is 1.2–3 times the minimum clearance value between the sleeve and photosensitive drum.

A roller magnet 29, that is, a magnetic field generating means, is fixedly disposed inside the developing sleeve 25. This roller magnet 29 has a development magnetic pole $S_1$ facing the developing station 26. The magnetic brush composed of the developer is formed by the development magnetic field induced in the developing station 26 by the magnetic pole $S_1$, and as this magnetic brush comes in contact with the photosensitive drum 3, it develops (visualizes) the electrostatic latent image. At this time, not only the toner adhering to the fiber of the magnetic brush, but also the toner adhering to the sleeve surface instead of the fiber, is transferred onto the exposed portion of the latent image, developing (visualizing) the image.

As to the magnitude (magnetic flux density in the direction normal to the sleeve surface) of the development magnetic field induced by the magnetic pole $S_1$, its peak value is preferred to be 500–2000 gauss.

In the case of this embodiment, the magnet has magnetic poles $N_1$, $N_2$, $N_3$, and $S_2$, in addition to the above mentioned magnetic pole $S_1$.

As the developing sleeve 25 rotates, with such a structure in place, the developer is picked up at the magnetic pole $N_2$ and is conveyed from $S_2$ to $N_1$, while being regulated by the regulating blade 28, and thereby forming the thin layer of developer. Then, the developer formed into a shape of a standing brush fiber in the magnetic field created by the magnetic pole $S_1$ develops (visualizes) the electrostatic latent image on the image bearing member 3. Next, developer on the developing sleeve 25 is dropped into the developing chamber R1 by the repulsive magnetic field created between the $N_3$ and $N_2$. The developer dropped into the developing chamber R1 is conveyed, while being stirred, by the conveyer screw 23 and conveyer screw 24.

Investigations have been made to solve the aforementioned problems, using such a developing apparatus as described above, and as a result, it was discovered that in order to eliminate the above mentioned roughness, it is preferable to increase the density (fiber count per unit area) of the magnetic brush fibers composed of the developer, in the developing station.

Also, it was discovered that the degree to which the magnetic carrier is magnetized in the developing station can be reduced as a method for increasing the magnetic brush fiber density.

For the measurement of the magnetic properties of the magnetic carrier, a DC magnetized B-H characteristic automatic recording apparatus BHH-50 (Riken Electronics Co., Inc.) can be used. Approximately 2 kg of the carrier is compacted in a cylindrical container measuring 6.5 mm in diameter (inner diameter) and 10 mm in height, so that the carrier does not shift in the container. Then, the degree of magnetization is measured.

Figure 9:
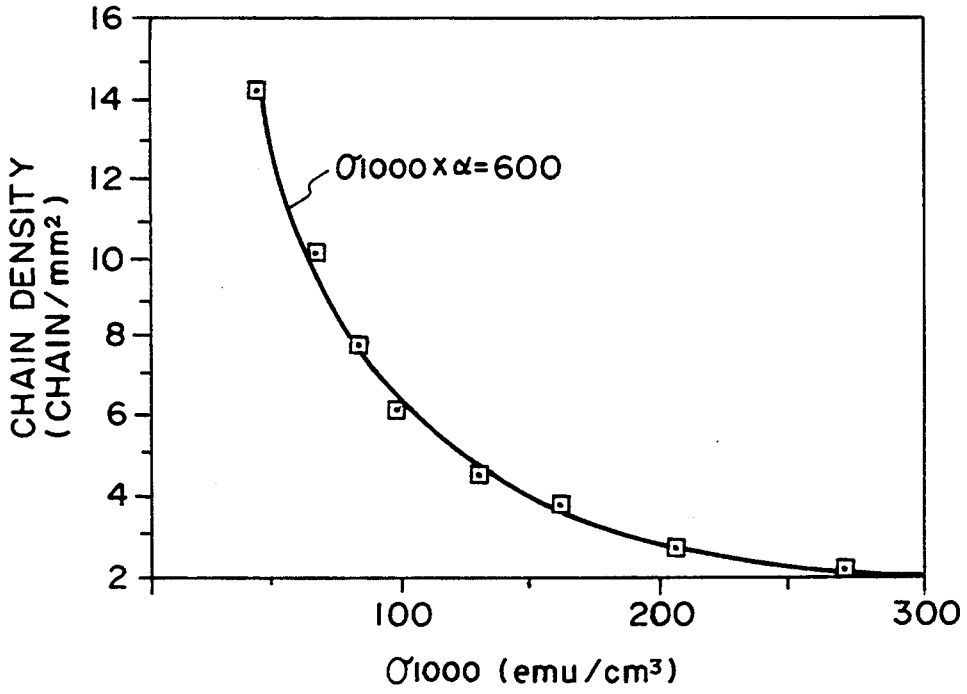
FIG. 9 is a graph showing the correlation between the carrier magnetization and the fiber density.

Since, a magnetic pole having a peak magnetic flux density value of 1000 gauss at the sleeve surface in the direction normal to the sleeve surface is employed as the magnetic pole $S_1$, the relation between the degree of carrier magnetization and the magnetic brush fiber density in the developing station is studied with reference to a case in which the magnetic force (magnetic flux density) is 1000 gauss, obtaining thereby the results shown in FIG. 9.

As is evident from FIG. 9, the relation between the degree of carrier magnetization induced by the peak magnetic flux density of the development magnetic field and the magnetic brush fiber density displays an inverse proportion. Where the fiber density is a (fiber/mm$^2$), and the degree of the carrier magnetization induced by the magnetic force of 1000 gauss is $\sigma_{1000}$(emu/cm$^3$), the following equation is obtained:

$$\alpha \times \sigma_{1000} = 600.$$

In other words, the smaller the $\sigma_{1000}$ is, higher the fiber density becomes.

When the relation is thought about between the developer fiber density and the roughness, the recording density (distribution density of the latent dot image, that is, picture element distribution density) must be taken into consideration. When the recording density is low, the roughness is hardly noticeable even if the fiber density is slightly low. However, when the recording density is high, it becomes necessary for the fiber density also to be high. Therefore, this embodiment is tested by varying the recording density from 200 dpi, 300 dpi, 400 dpi, to 600 dpi in the secondary scanning direction (moving direction of the photosensitive member), and from 200 dpi, 400 dpi, to 600 dpi in the primary scanning direction (scanning direction of the beam). Table 1 shows the relation between the magnetic brush fiber density and the roughness, with reference to each of the recording densities.

Figure 10:
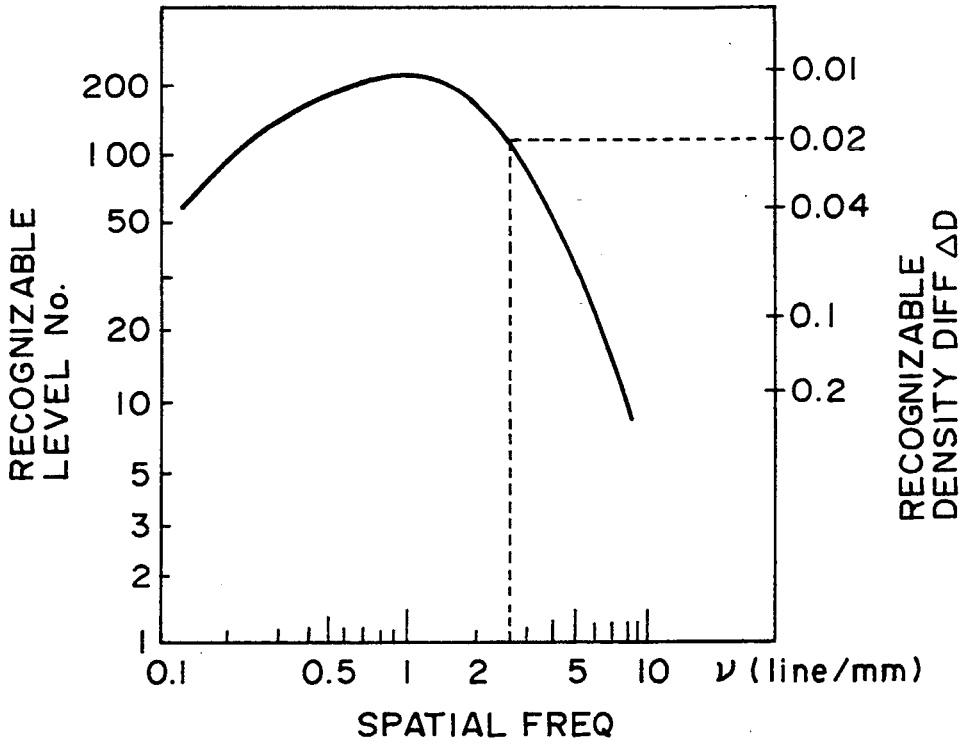
FIG. 10 is a graph showing the limitation of human visual acuity.

FIG. 10 shows the relation between spacial frequency (line/mm) and recognizable level L (density difference). ($L = 10^3 e^{-0.72\nu}(1 - e^{-0.52\nu}) + 1$)

In the low density portion having an image density of 0.2–0.3 at which, generally speaking, the roughness is likely to be noticeable, the range of density drift is approximately 0.02. Referring to FIG. 10, when the spacial frequency was higher than approximately 2.7 (line/mm), the density change of the above mentioned magnitude became impossible to recognize with the human eye. In other words, when the magnetic brush fiber density is no less than 7.3 (fiber/mm$^2$) ($2.7 \times 2.7 = 7.3$), the roughness is produced as a high frequency roughness, which is difficult to recognize because of the reason described above. Therefore, when the fiber density was no less than eight per square millimeter, the roughness was hardly noticeable even if the recording density was high and the picture element count per magnetic fiber was no less than 25.

Here, assuming that no less than one magnetic fiber is necessary per 25 picture element, the following equation can be obtained from the above equation, $\alpha \times \sigma_{1000} = 600$ $$\sigma_{1000} \leqq 600 \times 25/X = 15000/X$$

wherein X is a picture element count per square millimeter.

Further, referring to Table 1, in order to obtain a magnetic brush density of no less than eight fiber/mm$^2$, all that is needed is to satisfy one condition: $\sigma_{1000} \leqq 75$.

TABLE 1

| | | M-scan 200 Ls. S-scan 200 Ls. 62 pxls./mm$^2$ | | M-scan 200 Ls. S-scan 300 Ls. 93 pxls./mm$^2$ | | M-scan 200 Ls. S-scan 400 Ls. 124 pxls./mm$^2$ | | M-scan 400 Ls. S-scan 400 Ls. 248 pxls./mm$^2$ | | M-scan 600 Ls. S-scan 300 Ls. 279 pxls./mm$^2$ | | M-scan 600 Ls S-scan 600 Ls. 558 pxls./mm$^2$ | |
|---|---|---|---|---|---|---|---|---|---|---|---|---|---|
| $\sigma_{1000}$ (emu/cm$^3$) | $\alpha$ (fibers/mm$^3$) | Pixels per fiber | Roughness | Pixels per fiber | Roughness | Pixels per fiber | Roughness | Pixels per fiber | Roughness | Pixels per fiber | Roughness | Pixels per fiber | Roughness |
| 267 | 2.2 | 28 | D | 42 | D | 56 | E | 112 | E | 127 | E | 254 | E |
| 223 | 3 | 21 | C | 31 | D | 41 | D | 82 | E | 93 | E | 186 | E |
| 165 | 3.7 | 17 | B | 25 | C | 33 | D | 67 | D | 75 | E | 151 | E |
| 148 | 4.1 | 15 | A | 23 | C | 30 | D | 60 | D | 68 | D | 136 | E |
| 121 | 5 | 12 | A | 19 | B | 25 | C | 50 | D | 56 | D | 112 | E |
| 105 | 5.5 | 11 | A | 17 | B | 23 | C | 46 | D | 51 | D | 102 | D |
| 95 | 6.3 | 10 | A | 15 | A | 20 | B | 40 | D | 44 | D | 88 | D |
| 75 | 8 | 8 | A | 12 | A | 16 | B | 32 | C | 35 | C | 70 | C |
| 69 | 8.3 | 7.5 | A | 11 | A | 15 | A | 30 | C | 33 | C | 66 | C |
| 67 | 9 | 7 | A | 10 | A | 14 | A | 28 | B | 31 | B | 62 | B |
| 60 | 10 | 6 | A | 9 | A | 12.5 | A | 25 | A | 28 | A | 56 | A |
| 40 | 14 | 4 | A | 7 | A | 9 | A | 18 | A | 20 | A | 40 | A |

M-scan: Main scan,
S-scan: Sub-scan

In Table 1, reference codes indicates:

A: no roughness, extremely smooth picture quality

B: no roughness, more smooth (than C) picture quality

C: no visible roughness, smooth picture quality

D: presence of visible roughness

E: presence of extremely visible roughness

As is evident from the results shown in Table 1, even if the recording density was low, the roughness was hardly visible when the picture element count per fiber of magnetic brush was no more than 25.

When the fiber density was no less than 8 fiber/mm$^2$, the roughness was hardly visible even if the recording density was high and the picture element count per magnetic brush fiber was no less than 25. This is due to the limits of human visual acuity.

On the other hand, when the degree of carrier magnetization at the peak developing magnetic field value was no more than 30 (emu/cm$^3$), the developer could not be efficiently carried by the sleeve, deteriorating thereby the picture quality of the developed image or causing the developer to be likely to scatter, and therefore, the degree of carrier magnetization is preferred to be no less than 30 (emu/cm$^3$).

When the recording density X was no more than 60 picture element/mm$^2$, resolution could not be said to be desirable. Therefore, it is preferable for the present invention to be applied when the recording density X is no less than 60 picture element/mm$^2$. However, when the recording density X was increased beyond 10000 picture element/mm$^2$, it also became difficult to develop the dot image with use of the dry process toner particles. Therefore, the present invention is preferable to be applied when the recording density is no more than 10000 picture element/mm$^2$.

Figure 1:
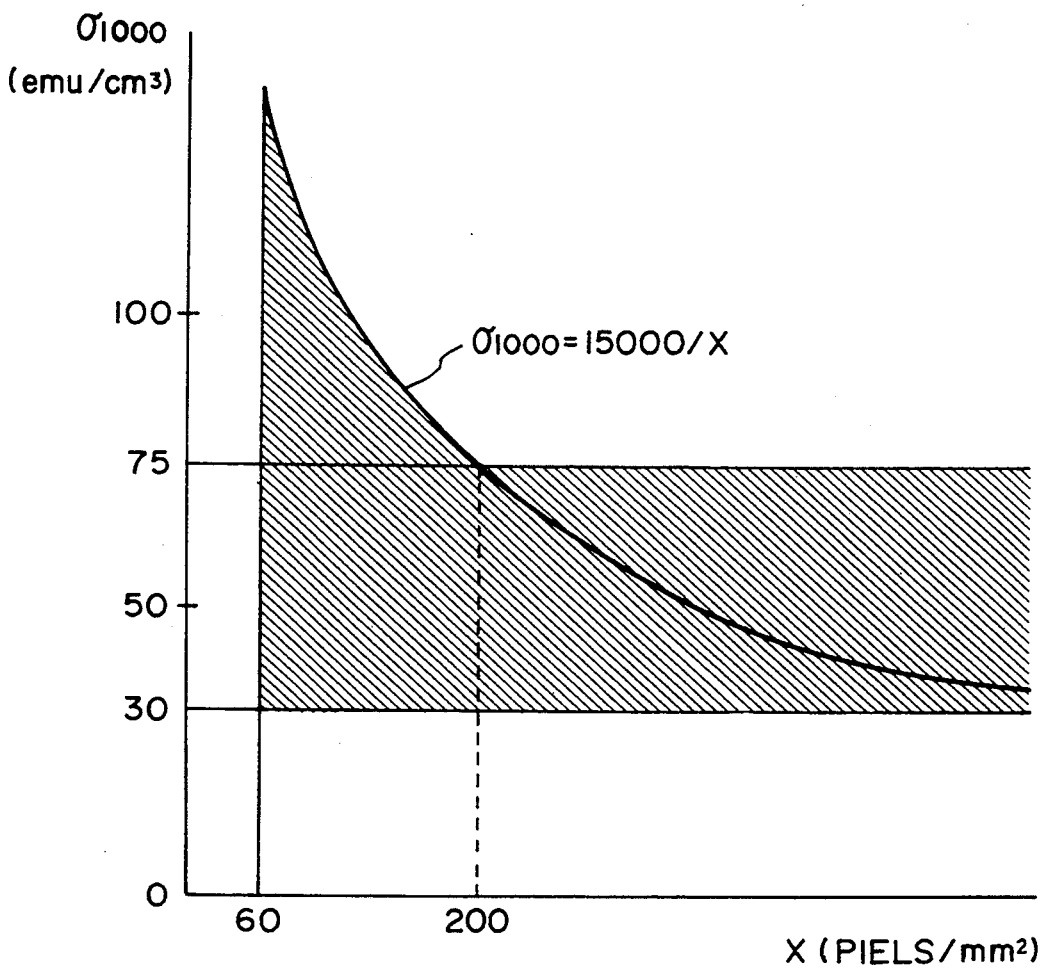
FIG. 1 is a graph depicting the preferred range of the correlation between the degree of magnetization of the magnetic carrier particle and the recording density.
Figure 2:
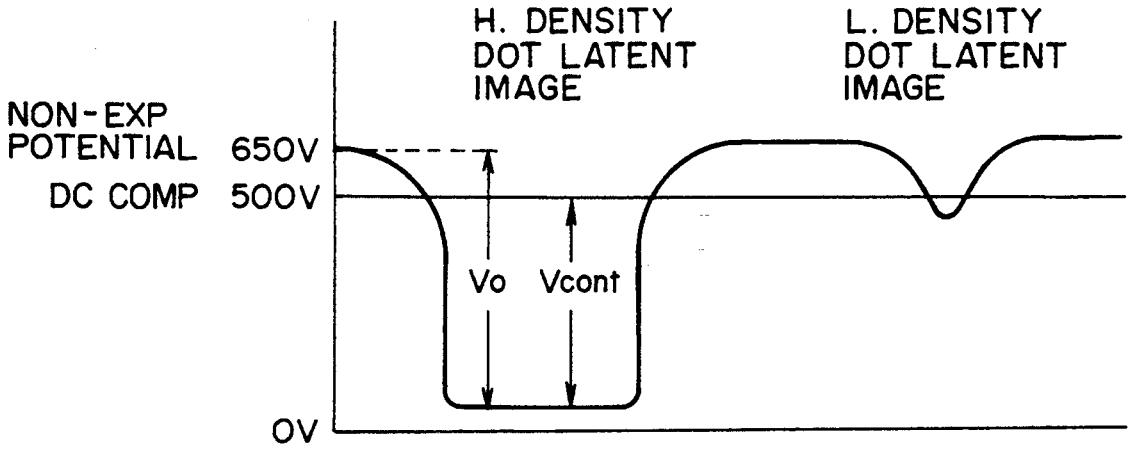
FIG. 2 is a graph depicting the potential of the latent dot distribution image.
Figure 3:
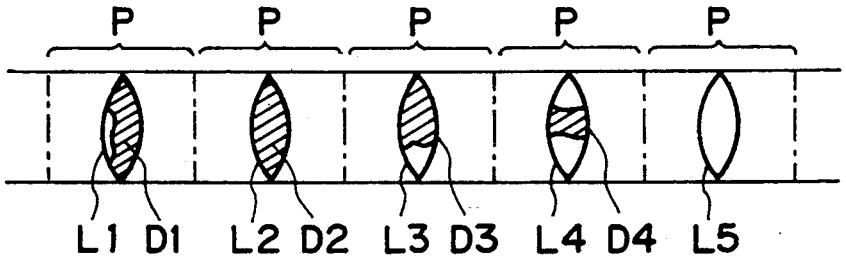
FIG. 3 is a conceptual drawing describing the developed image of the latent dot distribution image.

Thus, when the relation between the picture element count X per square millimeter and $\sigma_{1000}$ falls within the area covered by the solidus in FIG. 1, an excellent picture without roughness can be obtained. In other words, it is possible to suppress an occurrence of the imperfectly developed image such as D1, D3, and D4, or the undeveloped latent dot image like L5.

Since the X at the intersection of the above two equations is 200 (picture element/mm$^2$), the following statement can be made.

That is, use of the magnetic carrier satisfying the following conditions makes it less likely for the roughness to occur, thereby making it possible to obtain an image having an excellent halftone across the entire density range:

if $X \leqq 200$, then, $\sigma d \leqq 15000/X$ if $X \geqq 200$, then, $\sigma d \leqq 75$ wherein $\sigma d$ (emu/cm$^3$) is the degree of magnetic carrier magnetization at the sleeve surface, induced by the development magnetic field when the magnetic flux density having a peak value of (d gauss) is imparted in the direction normal to the sleeve surface.

Further, it is evident from Table 1 that when the magnetic fiber count is no less than one per 15 picture elements or no less than 10 fiber/mm$^2$, the roughness is hardly noticeable to the human eye. To realize this condition, it is desirable to use a magnetic carrier which can satisfy the following requirements.

if $X < 150$, then, $\sigma d < 9000/X$ (for no less than one magnetic fiber per 15 picture elements)

if $X \geqq 150$, then, $\sigma d < 60$ (for no less than 10 fiber/mm$^2$).

The reason why the above value 150 is used is because the value of X at the intersection of the aforementioned two equations is 150 (picture element/mm$^2$).

The cases hereinbefore referred to when the peak value d of the development magnetic field is 1000 gauss, but the same results were also obtained when the peak value d was other than 1000 gauss.

Figure 11:
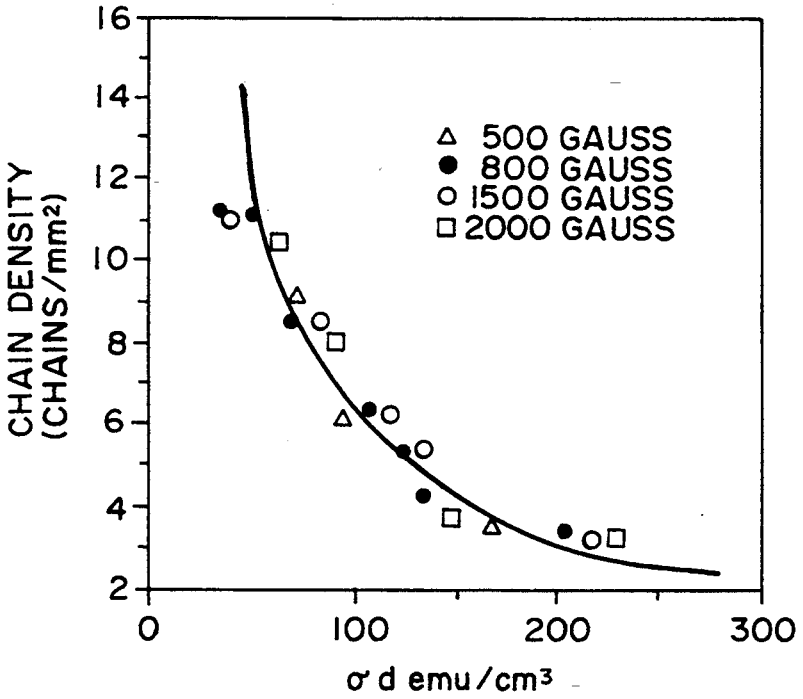
FIG. 11 is a graph of the correlation between the peak magnitude of the development magnetic field and the carrier magnetization.

FIG. 11 shows the relation between the degree $\sigma d$ (emu/cm$^3$) of magnetization and the fiber density a (fiber/mm$^2$) of the magnetic brush, with reference to when d (gauss) is 500, 800, 1500, or 2000. It is evident that the equation, $\sigma d \times \alpha = 600$, is satisfied in any of these cases.

Further, with reference to when d (gauss) was 500, 800, 1500, or 2000, the fiber density of the magnetic brush became no less than 8 fiber/mm$^2$ when $\sigma d$ was no more than 75 emu/cm$^3$ and no less than 10 fiber/mm$^2$ when $\sigma d$ was no more than 60 emu/cm$^3$.

Therefore, it is evident that the fiber density of the magnetic brush and the prevention of the roughness in the image developed from the latent dot distribution image are not dependent on the peak magnitude d (gauss) of the development magnetic field, but are dependent on the degree $\sigma d$ (emu/cm$^3$) of the carrier magnetization within the magnetic field of d gauss.

Figure 12:
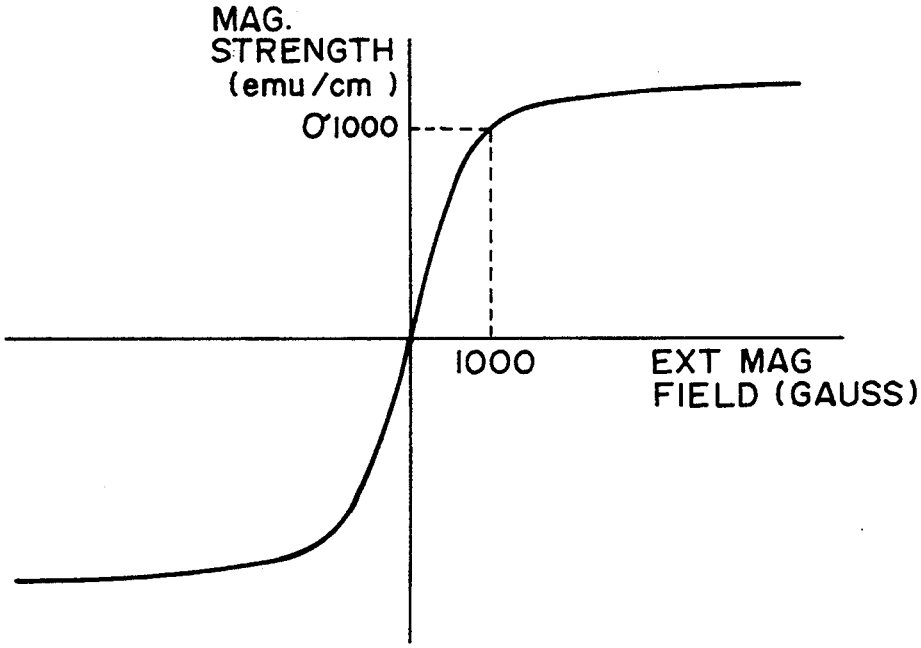
FIG. 12 is a graph of a hysteresis curve for a soft ferromagnetic carrier.

In the aforementioned examples, a carrier having a hysteresis characteristic as shown in FIG. 12, that is, a soft ferromagnetic material, was used. However, a carrier having a hysteresis characteristic as shown in FIG. 13, that is, a hard ferromagnetic material, may be used.

Figure 13:
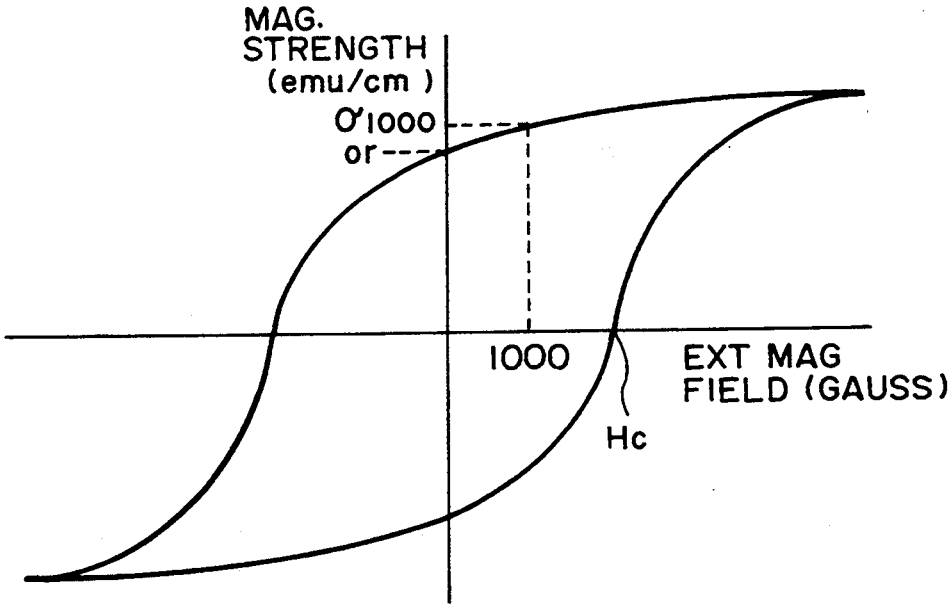
FIG. 13 is a graph of a hysteresis curve for a hard ferromagnetic carrier.

The hard ferromagnetic carrier as shown in FIG. 13 is characterized by possessing a coercive force Hc and a residual magnetization $\sigma_T$. Since the hard ferromagnetic material has the residual magnetization $\sigma_T$, the magnetization remains even in the condition in which an external magnetic field has subsided (condition in which the magnetic field has been moved away from the developing station), attracting forces between carrier particles are stronger, which makes the hard ferromagnetic carrier advantageous over the soft ferromagnetic carrier, with reference to the prevention of carrier adhesion (phenomenon in which the carrier adheres to the image portion, deteriorating the image quality).

Figure 14:
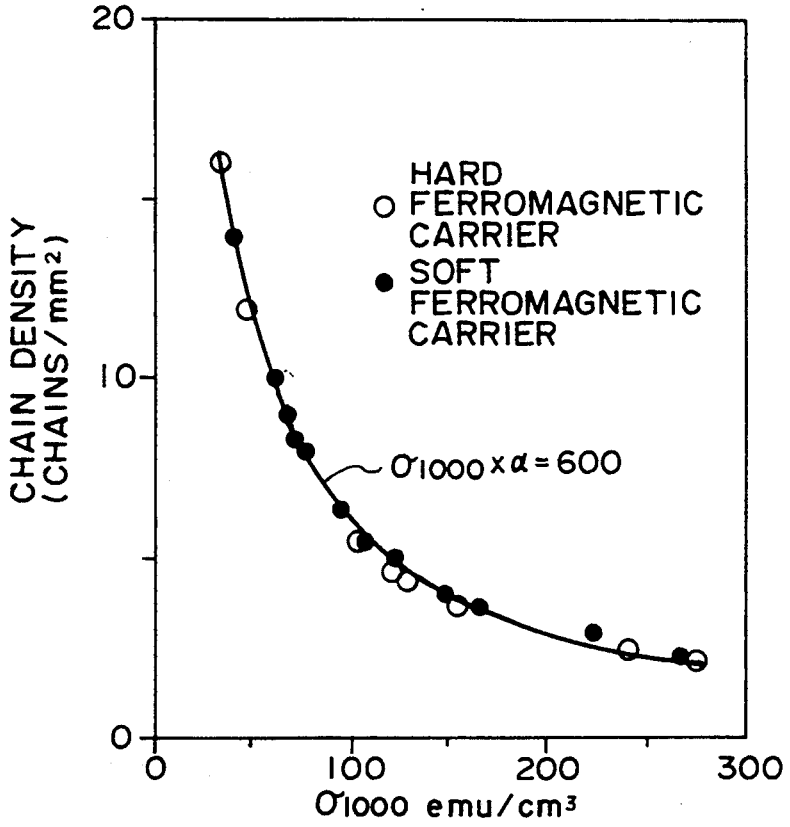
FIG. 14 is a graph of the correlations between the hard ferromagnetic carrier magnetization and the fiber density, and between the soft ferromagnetic carrier magnetization and the fiber density.

In this embodiment, the same image forming method (pulse width modulation) and apparatus structure as the foregoing embodiment in which the soft ferromagnetic carrier was employed was used, and only the carrier of the developer was changed. As far as the coercive force is concerned, all of the employed carriers had approximately 2000 (Oe), but they were different in the degree of magnetization $\sigma_{1000}$ (emu/cm$^3$) caused by the magnetic force of 1000 gauss and in the residual magnetization $\sigma_T$. In FIG. 14, the white circle shows the fiber density of the magnetic brush formed in the developing station, with use of the magnetic pole $S_1$ having a peak value d of 1000 gauss, and the results of the evaluation of the image obtained by developing the electrostatic latent dot distribution image is shown in Table 2.

TABLE 2

| | | M-scan 200 Ls. S-scan 200 Ls. 62 pxls./mm$^2$ | | M-scan 200 Ls. S-scan 300 Ls. 93 pxls./mm$^2$ | | M-scan 200 Ls. S-scan 400 Ls. 124 pxls./mm$^2$ | | M-scan 400 Ls. S-scan 400 Ls. 248 pxls./mm$^2$ | | M-scan 600 Ls. S-scan 300 Ls. 279 pxls./mm$^2$ | | M-scan 600 Ls S-scan 600 Ls. 558 pxls./mm$^2$ | |
|---|---|---|---|---|---|---|---|---|---|---|---|---|---|
| $\sigma_{1000}$ (emu/cm$^3$) | $\alpha$ (fibers/mm$^3$) | Pixels per fiber | Roughness | Pixels per fiber | Roughness | Pixels per fiber | Roughness | Pixels per fiber | Roughness | Pixels per fiber | Roughness | Pixels per fiber | Roughness |
| 275 | 2.2 | 28 | D | 42 | D | 56 | E | 112 | E | 127 | E | 254 | E |
| 240 | 2.5 | 25 | C | 37 | D | 50 | D | 99 | E | 111 | E | 223 | E |
| 153 | 3.7 | 17 | B | 25 | C | 33 | D | 67 | D | 75 | E | 151 | E |
| 128 | 4.5 | 14 | A | 21 | C | 28 | D | 56 | D | 62 | D | 124 | E |
| 119 | 4.7 | 13 | A | 20 | B | 26 | D | 53 | D | 59 | D | 119 | E |
| 102 | 5.5 | 11 | A | 17 | B | 23 | C | 45 | D | 51 | D | 101 | D |
| 94 | 6.3 | 10 | A | 15 | A | 20 | B | 40 | D | 44 | D | 88 | D |
| 75 | 8 | 8 | A | 12 | A | 16 | B | 32 | C | 35 | C | 70 | C |
| 67 | 9 | 7 | A | 10 | A | 14 | A | 28 | B | 31 | B | 62 | B |
| 60 | 10 | 6 | A | 9 | A | 12.5 | A | 25 | A | 28 | A | 56 | A |
| 45 | 12 | 5 | A | 8 | A | 10 | A | 21 | A | 23 | A | 47 | A |
| 35 | 16 | 4 | A | 6 | A | 8 | A | 16 | A | 17 | A | 35 | A |

M-scan: Main scan,
S-scan: Sub-scan

In Table 2, the meanings of the reference codes are the same as in Table 1.

As shown in FIG. 14, the equation, $\alpha \times \sigma_{1000} = 600$, is also satisfied in the case of the hard ferromagnetic carrier, as in the case of the above described soft ferromagnetic carrier.

Referring to Table 2, it is evident that when the picture element count was no more than 25 per magnetic fiber, the roughness was hardly visible even if the recording density was low.

Further, when the fiber density was no less than 8 fiber/mm$^2$, the roughness was hardly noticeable even if the recording density was high and the picture element count per magnetic fiber was no less than 25. This is due to the limitations of human visual acuity, as stated before.

Referring to Table 2, it is evident that when the fiber count was no less than 1 fiber/15 picture elements or 10 fiber/mm$^2$, the roughness was hardly visible.

Figure 15:
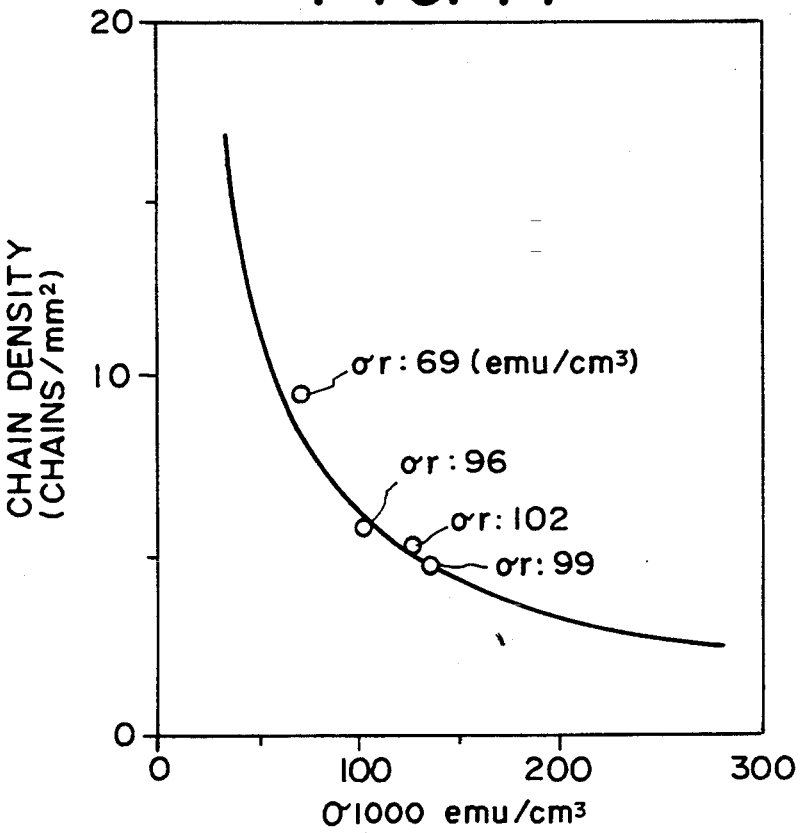
FIG. 15 is a graph of the correlation between the hard ferromagnetic carrier magnetization and the fiber density.

Referring to FIG. 15, the equation, $\alpha \times \sigma d = 600$, is satisfied even when the residual $\sigma r$ (emu/cm$^3$) of the hard magnetic carrier is different. In other words, the fiber density of the magnetic brush is not dependent on the residual magnetization of the carrier but is dependent on the degree of carrier magnetization by the peak magnetic field d (gauss).

In the foregoing embodiment, the peak value d of the development magnetic field was 1000 gauss. However, the results were the same even when the peak value d was other than 1000 gauss.

In other words, the equation, $\sigma d \times \alpha = 600$, was satisfied in any of the cases when d (gauss) was 500, 800, 1500, or 2000.

Further, whether d (gauss) was 500, 800, 1500, or 2000, the fiber density of the magnetic brush became no less than 8 fiber/mm$^2$ when ad was no more than 75 emu/cm$^3$, and no less than 10 fiber/mm$^2$ when $\sigma d$ was no more than 60 emu/cm$^3$.

Therefore, the hard ferromagnetic carrier can produce the same results as the soft ferromagnetic carrier described hereinbefore. In other words, by employing a carrier satisfying the following conditions, the latent dot distribution image can be developed without any imperfection, exhibiting hardly any of the roughness, and therefore, it is possible to obtain excellent halftone across the entire density range: if $X < 200$, then, $\sigma d \leqq 15000/X$ (no less than 1 fiber/25 picture elements)

if $X \geqq 200$, then, $\sigma d \leqq 75$ (no less than 8 fiber/mm$^2$).

It is more preferable to employ a carrier satisfying the following conditions:

if $X < 150$, then $\sigma d < 9000/X$ (no less than 1 fiber/15 picture elements)

if $X \geqq 150$, then $\sigma d < 60$ (no less than 10 fiber/mm$^2$).

Even in the case of the hard ferromagnetic carrier, $\sigma d \geqq 30$ (emu/cm$^3$), and $60 \leqq X \leqq 10000$.

In other words, when the hard ferromagnetic carrier is used, the fiber density of the magnetic brush and the prevention of the roughness in the image developed from the latent dot distribution image are dependent not on the peak magnitude d (gauss) of the development magnetic field but on the degree $\sigma d$ (emu/cm$^3$) of the carrier magnetization in the magnetic field of d gauss.

The magnetic carrier is composed of ferrite, containing at least one element chosen from among the elements belonging to IA, IIA, IIIA, IVA, VA, IB, IIB, IVB, VIB, VIIB, or VIII group of the periodic table. For example, Ni—Zn ferrite, Li ferrite, Li—Zn ferrite, or Mn—Cu ferrite may be employed. The magnitude of $\sigma d$ can be adjusted by means of adjusting the composition as needed. It is needless to say that the choice of the carrier material is not limited to those listed above.

Also, the present invention can be applied to realize tone by the dither method.

The application of the present invention is not limited to those described above. The present invention includes all the modifications and improvements made within the technical scope of the present invention.

What is claimed is:

1. An image forming apparatus, comprising:

an image bearing member for bearing an electrostatic latent image;

image forming means for forming on said image bearing member a dot distribution electrostatic image with a recording density of X pixels per 1 mm$^2$, in accordance with image signals; and developing means for developing the electrostatic image formed on said image bearing member with a non-magnetic toner, said developing means comprising a developer carrying member for carrying a nonmagnetic toner and a magnetic carrier, and magnetic field generating means located within said developer carrying member;

wherein a degree $\sigma d$ (emu/cm$^3$) of magnetization of said magnetic carrier by a magnetic field generated by said magnetic field generating means at a peak of a perpendicular magnetic field on a surface of said developer carrying member satisfies the following:

if $X < 200$, then $\sigma d \leqq 15000/X$ if $X \geqq 200$, then $\sigma d \leqq 75$.

2. An image forming apparatus according to claim 1, wherein the degree $\sigma d$ of magnetization satisfies the following:

if $X < 150$, then $\sigma d < 9000/X$ if $X \geqq 150$, then $\sigma d < 60$.

3. An image forming apparatus according to claim 1, wherein the peak is 500–2000 gauss.

4. An image forming apparatus according to claim 1, wherein said magnetic field generating means is a magnet having a magnetic pole.

5. An image forming apparatus according to claim 1, wherein said image bearing member is an electrophotographic photosensitive member, and said image forming means forms the electrostatic image by exposing said electrophotographic photosensitive member to a beam modulated in accordance with signals pulse-width-modulated in accordance with a tone of an object image.

6. An image forming apparatus according to claim 5, wherein said developing means carries out a reverse development process in which toner is adhered to areas exposed to the beam.

7. An image forming apparatus according to claim 1, wherein an oscillating bias voltage is applied to said developer carrying member.

8. An image forming apparatus according to claim 1, wherein said magnetic carrier is a soft ferromagnetic carrier.

9. An image forming apparatus according to claim 1, wherein said magnetic carrier is a hard ferromagnetic carrier.

10. An image forming apparatus according to claim 1, wherein said developing means comprises two or more developing apparatuses corresponding to a number of two or more color toners, so that a color image is formed by two or more color toners superposed by corresponding developing apparatuses.

11. An apparatus according to claim 1, wherein $30 \leqq \sigma d$.

12. An apparatus according to claim 1, wherein X is no less than 60 and no more than 1000.

13. An apparatus according to claim 1, wherein a magnetic brush is formed on said developer carrying member by the magnetic field generated by said magnetic field generating means, and the magnetic brush is contacted to said image bearing member.

* * * * *

UNITED STATES PATENT AND TRADEMARK OFFICE

CERTIFICATE OF CORRECTION

PATENT NO. : 5,438,394

DATED : August 1, 1995

INVENTOR(S) : Suzuki, et al

It is certified that error appears in the above-indentified patent and that said Letters Patent is hereby corrected as shown below:

In the drawings:

Sheet 1

FIG. 1, "(PIELS/$mm^2$)" should read --(PIXELS/$mm^2$)--.

Sheet 6

FIG. 7, "EFECT" should read --EFFECT--.

Column 1

Line 60, "in case of the" should read --in the case of--.

Column 11

Line 32, "requirements." should read --requirements:--.

Column 13

Line 46, "range:" should read --range: ¶ --.

UNITED STATES PATENT AND TRADEMARK OFFICE

CERTIFICATE OF CORRECTION

PATENT NO. : 5,438,394

DATED : August 1, 1995

INVENTOR(S) : Suzuki, et al

It is certified that error appears in the above-indentified patent and that said Letters Patent is hereby corrected as shown below:

Column 14

Line 23, "nonmagnetic" should read --non-magnetic--.

Signed and Sealed this

Twelfth Day of December, 1995

*Attest:*

Bruce Lehman

BRUCE LEHMAN

*Attesting Officer*

*Commissioner of Patents and Trademarks*